US009478208B2

(12) United States Patent
Ishida et al.

(10) Patent No.: US 9,478,208 B2
(45) Date of Patent: Oct. 25, 2016

(54) ACOUSTIC DEVICE, AND ELECTRONIC DEVICE AND IMAGE FORMING APPARATUS INCORPORATING SAME

(71) Applicants: Masahiro Ishida, Kanagawa (JP); Naoki Matsuda, Kanagawa (JP)

(72) Inventors: Masahiro Ishida, Kanagawa (JP); Naoki Matsuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/978,890

(22) Filed: Dec. 22, 2015

(65) Prior Publication Data

US 2016/0111075 A1 Apr. 21, 2016

Related U.S. Application Data

(63) Continuation of application No. 14/629,933, filed on Feb. 24, 2015, now Pat. No. 9,261,852.

(30) Foreign Application Priority Data

Feb. 27, 2014 (JP) ..... 2014-036268

(51) Int. Cl.

| | |
|---|---|
| ***G03G 21/00*** | (2006.01) |
| ***G10K 11/00*** | (2006.01) |
| ***G03G 21/16*** | (2006.01) |
| ***G10K 15/04*** | (2006.01) |
| ***G10K 11/172*** | (2006.01) |
| ***G10K 9/02*** | (2006.01) |
| ***G10K 11/04*** | (2006.01) |

(52) U.S. Cl.

CPC ..... *G10K 11/002* (2013.01); *G03G 21/1604* (2013.01); *G10K 9/02* (2013.01); *G10K 11/04* (2013.01); *G10K 11/172* (2013.01); *G10K 15/04* (2013.01)

(58) Field of Classification Search

CPC .. G03G 21/00; G03G 21/1604; G10K 15/04; G10K 11/16; G10K 11/162; G10K 11/172; G10K 11/002; G10K 11/04; G10K 9/02

USPC ..... 399/91, 107; 181/175

See application file for complete search history.

(56) References Cited

U.S. PATENT DOCUMENTS

| | | | | |
|---|---|---|---|---|
| 2004/0190928 | A1 | 9/2004 | Tsunoda et al. | 399/91 |
| 2006/0050346 | A1 | 3/2006 | Kim | |
| 2008/0078611 | A1 | 4/2008 | Inoue et al. | 181/206 |

(Continued)

FOREIGN PATENT DOCUMENTS

| | | | |
|---|---|---|---|
| DE | 112011103712 | T5 | 8/2013 |
| EP | 2595142 | A1 | 5/2013 |

(Continued)

OTHER PUBLICATIONS

Machine translation of JP 2000-235396 (published on Aug. 29, 2000) printed on Jan. 5, 2015.

(Continued)

*Primary Examiner* — Sophia S Chen

(74) *Attorney, Agent, or Firm* — Harness, Dickey & Pierce, P.L.C.

(57) ABSTRACT

An acoustic device includes an opening; a flange forming the opening; a first member including the opening and the flange; and a second member joined to the first member, thereby forming a cavity. The second member is formed of a material with a density lower than a material of the first member.

12 Claims, 7 Drawing Sheets

(56) References Cited

U.S. PATENT DOCUMENTS

| | | | | |
|---|---|---|---|---|
| 2010/0171022 | A1 | 7/2010 | Fujimaki et al. | 248/559 |
| 2013/0064661 | A1 | 3/2013 | Evans et al. | 415/208.1 |
| 2013/0228686 | A1 | 9/2013 | Muto et al. | |

FOREIGN PATENT DOCUMENTS

| | | | |
|---|---|---|---|
| JP | 3-029028 | | 2/1991 |
| JP | 10-1091171 | | 4/1998 |
| JP | 11-148618 | | 6/1999 |
| JP | 2000-077858 | | 3/2000 |
| JP | 2000-112306 | A | 4/2000 |
| JP | 2000-235396 | | 8/2000 |
| JP | 2003-043861 | | 2/2003 |
| JP | 2008-090931 | | 4/2008 |
| JP | 2011058188 | A | 3/2011 |
| JP | 2011154397 | A | 8/2011 |

OTHER PUBLICATIONS

European Search Report issued by the European Patent Office on Nov. 23, 2015 for EP Application No. 15156579.

ACOUSTIC DEVICE, AND ELECTRONIC DEVICE AND IMAGE FORMING APPARATUS INCORPORATING SAME

CROSS-REFERENCE TO RELATED APPLICATION

This application is a continuation of U.S. application Ser. No. 14/629,933, filed on Feb. 24, 2015, which claims priority under 35 U.S.C. §119 to Japanese patent application number 2014-036268, filed on Feb. 27, 2014, in the Japan Patent Office, the entire contents of each of which are incorporated by reference herein.

BACKGROUND

1. Technical Field

Exemplary embodiments of the present invention relate to an acoustic device employing a Helmholtz resonator, and further relates to an electronic device and an image forming apparatus employing the acoustic device.

2. Background Art

Various sounds are generated when various driving devices are driven or a polygon mirror is rotating in the image forming apparatus employing the electrophotographic method. Conventionally, an image forming apparatus including an acoustic device employing a Helmholtz resonator as a structure capable of absorbing sounds generated during image formation, is known.

The Helmholtz resonator is formed of a cavity with a certain volume and a port or a neck. If a static volume of the cavity is V, a cross-sectional area of the port is S, a length of the port in the connection direction is H, and acoustic velocity is c, then a resonant frequency f absorbed by the Helmholtz resonator is obtained by the following formula (1).

$$f=c/2\times\{S/(V\times H\}^{1/2} \quad (1)$$

In an acoustic device employing the Helmholtz resonator, the cavity needs to be sealed from the external portion to obtain the desired absorption effect.

Based on the above equation (1), it is clear that the volume V of the cavity should be increased as a method of absorbing low-frequency sounds of less than 1,500 [Hz].

SUMMARY

In one embodiment of the disclosure, there is provided an acoustic device including an opening; a flange forming the opening; a first member, such as a port forming member, including the opening and the flange; and a second member, such as a cavity forming member, joined to the first member, thereby forming a cavity. The second member is formed of a material with a density lower than a material of the first member.

In one embodiment of the disclosure, there are provided an electronic device and an image forming apparatus including the acoustic device employing the Helmholtz resonator.

These and other objects, features, and advantages of the present invention will become apparent upon consideration of the following description of the preferred embodiments of the present invention when taken in conjunction with the accompanying drawings.

DETAILED DESCRIPTION

Hereinafter, a first embodiment of an image forming apparatus (hereinafter, to be referred to simply as a printer 100) employing the electrophotographic method will be described.

First, a basic configuration of the printer 100 will be described.

Figure 2:
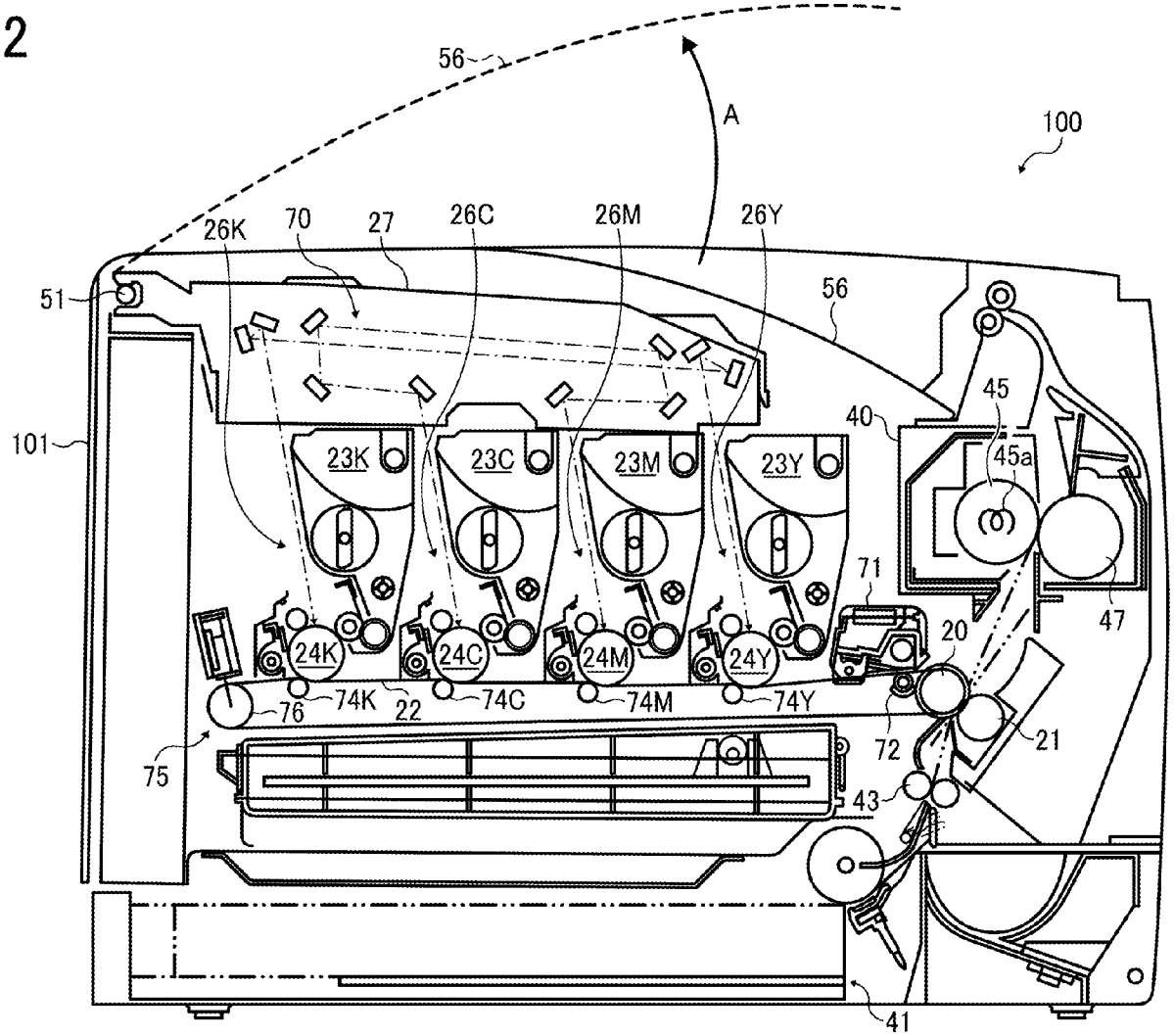
FIG. 2 illustrates a printer as an image forming apparatus according to an embodiment of the present invention.

As illustrated in FIG. 2, the printer 100 includes four process units 26K, 26C, 26M, and 26Y to form a toner image of respective colors of black (K), cyan (C), magenta (M), and yellow (Y). Except that the process units 26 (K, C, M, Y) employ toner with different colors K, C, M, and Y from each other, all process units are similarly configured and are replaced when spent.

Figure 3:
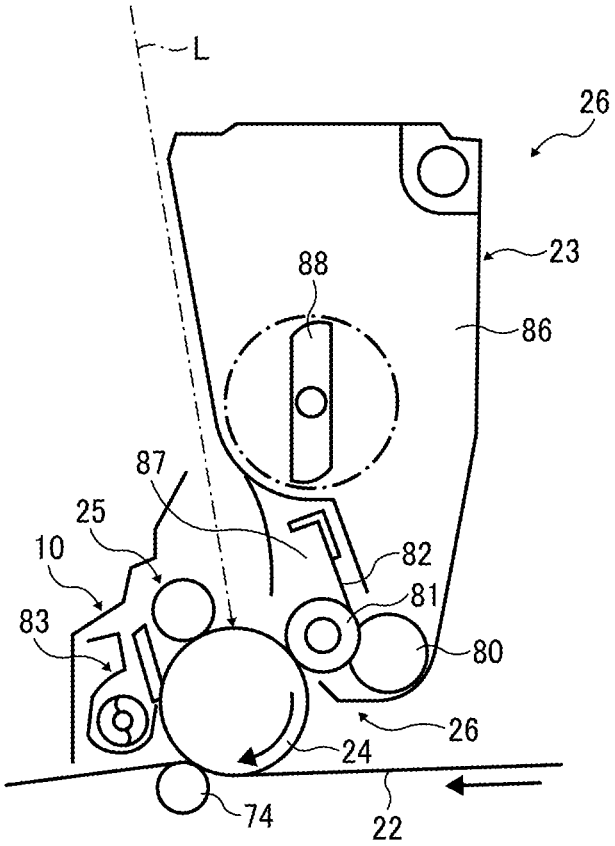
FIG. 3 illustrates a process unit included in the printer of FIG. 2.

FIG. 3 is an enlarged view of one of the process units 26. Because the four process units 26 are configured similarly to each other except that the color of toner used is different, suffixes (K, C, M, Y) each showing a color of toner are omitted in FIG. 3.

As illustrated in FIG. 3, the process unit 26 includes a drum-shaped photoconductor 24, a drum cleaner 83 for the photoconductor, a photoconductor unit 10 to hold a discharger and a charger roller 25, and a developer unit 23. The photoconductor 24 is drum-shaped and serves as a latent image carrier. Each process unit 26 as an image formation unit is detachably disposed on the printer body and is replaceable as a consumable part at once.

The charger roller 25 uniformly charges a surface of the photoconductor 24 rotating in the clockwise direction driven by a drive unit as illustrated in FIG. 3. The thus-uniformly-charged surface of the photoconductor 24 is exposed by a laser beam L to thereby carry an electrostatic latent image of each color. The electrostatic latent image is developed into a toner image by the developer unit 23 using the toner. The toner image is thus developed is primarily transferred onto an intermediate transfer belt 22, which is called a primary transfer.

The drum cleaner 83 removes residual toner deposited on the surface of the photoconductor 24 after the primary transfer. The discharger serves to electrically discharge a residual potential on the photoconductor 24 after the above cleaning process. By this electrical discharge, the surface of the photoconductor 24 is initialized and becomes ready for a following image formation.

The cylinder-shaped drum portion of the photoconductor 24 is formed of a hollow aluminum tube and a coating of organic photoconductive layer coated on an external surface of the aluminum tube. Flanges each including a drum shaft are attached at both lateral ends of the drum portion in an axial direction, to thus form the photoconductor 24.

The developer unit 23 includes a longitudinal hopper 86 to contain toner as a developer or a developing agent, and a developing device 87. Inside the hopper 86, there are provided: an agitator 88, a toner supply roller 80, and the like. The agitator 88 is rotatably driven by a driving means. The toner supply roller 80 is disposed below the agitator 88 in the vertical direction and is rotatably driven by a driving means. The toner in the hopper 86 is agitated by a rotary drive of the agitator 88 and is moved toward the toner supply roller 80 by its own weight. The toner supply roller 80 includes a metal core and a roller portion which is formed of foamed resins and is coated on a surface of the metal core. The toner supply roller 80 rotates while adhering the toner accumulated in the bottom of the hopper 86 on its surface thereof.

Inside the developing device 87 of the developer unit 23, a developing roller 81 rotating while contacting the photoconductor 24 and the toner supply roller 80, and a thin-layer forming blade 82 a tip end of which contacts a surface of the developing roller 81 are disposed. The toner adhered to the toner supply roller 80 inside the hopper 86 is supplied to the surface of the developing roller 81 at a contact portion between the developing roller 81 and the toner supply roller 80. The toner supplied on the surface of the developing roller 81 is regulated its layer height when passing through the contact position between the developing roller 81 and the thin-layer forming blade 82. The toner, of which layer height has been regulated, reaches a developing area being the contact portion between the developing roller 81 and the photoconductor 24, and adheres on the electrostatic latent image formed on the surface of the photoconductor 24. Due to the adhesion of the toner, the electrostatic latent image is rendered visible as a toner image.

Formation of the toner image is done with each process unit 26, and a toner image of each color is formed on each of the photoconductor 24 included in each photoconductor 24.

As illustrated in FIG. 2, an optical writing unit 27 is disposed vertically above the four process units 26. The optical writing unit 27 as a latent image writing device optically scans each photoconductor 24 in each of the four process units 26 with the laser beam L emitted from a laser diode based on image data. Due to this optical scanning, a latent image corresponding to each color is formed on the surface of the photoconductor 24. With this structure, the optical writing unit 27 and the four process units 26 serve as visible K-, C-, M-, and Y-toner image forming means on at least three latent image carriers.

The optical writing unit 27 includes a light source, a laser diode included in the light source, a plurality of optical lenses and mirrors, a polygon mirror, and a polygon motor; and causes the light source to emit laser beams L onto the photoconductor via the plurality of optical lenses and mirrors while laser beams being deflected by the polygon mirror driven by the polygon motor. Alternatively, the optical writing unit 27 may perform optical writing by the LED light emitted from a plurality of LEDs of LED arrays.

A transfer unit 75 is a belt unit disposed vertically below the four process units 26, and moves the endless-belt shaped intermediate transfer belt 22, while stretching it, in the counterclockwise direction in FIG. 2. The transfer unit 75 includes, other than the intermediate transfer belt 22, a drive roller 76, a tension roller 20, four primary transfer rollers 74 (K, C, M, and Y), a secondary transfer roller 21, a belt cleaner 71, a cleaner backup roller 72, and the like.

The intermediate transfer belt 22 is supported by the drive roller 76, the tension roller 20, the cleaner backup roller 72, and the four primary transfer rollers 74 (K, C, M, and Y) that are disposed inside the loop formed by the intermediate transfer belt 22. The thus-configured intermediate transfer belt 22 is rotated in the counterclockwise direction driven by the drive roller 76 that rotates counterclockwise driven by a drive means.

The rotating intermediate transfer belt 22 is sandwiched between the four primary transfer rollers 74 (K, C, M, and Y) and the photoconductors 24 (K, C, M, and Y), respectively. With this nipping, an outer surface of the intermediate transfer belt 22 contacts each of the photoconductors (K, C, M, and Y) 24, respectively, thereby forming four primary transfer nips for K-, C-, M-, and Y-color.

Each of the primary transfer rollers 74 (K, C, M, and Y) is supplied with a primary transfer bias from a transfer bias power source, whereby a transfer electric field is generated between the photoconductors 24 (K, C, M, and Y) and the primary transfer rollers 74 (K, C, M, and Y), respectively. In place of the primary transfer rollers 74 (K, C, M, and Y), a transfer charger or a transfer brush may be used.

The Y-toner image formed on the surface of the photoconductor 24 for Y-color of the process unit 26Y for Y-color enters into the primary transfer nip for Y-color accompanies by a rotation of the photoconductor 24Y for Y-color. The Y-toner image formed on the surface of the photoconductor 24 for Y-toner is primarily transferred on the intermediate transfer belt 22 due to an effect of the transfer electric field and nip pressure. The surface of the intermediate transfer belt 22 on which the Y-toner image has been transferred passes through the primary transfer nip for M-, C-, and K-colors according to the rotation of the belt 22, and the M-, C-, and K-toner images on the photoconductors 24 (M, C, and K) are sequentially, primarily transferred on the Y-toner image in a superimposed manner. With the superimposing primary transfer, a four-color toner image is formed on the intermediate transfer belt 22.

The secondary transfer roller 21 of the transfer unit 75 is positioned outside the loop of the intermediate transfer belt 22 and includes the intermediate transfer belt 22 nipped between the tension roller 20 disposed inside the loop and the secondary transfer roller 20 itself. With this nipping, a secondary transfer nip is formed at a portion where the outer surface of the intermediate transfer belt 22 contacts the secondary transfer roller 21. The secondary transfer roller 21 is supplied with a secondary transfer bias from a transfer bias power supply. With this application, a secondary transfer electric field is formed between the secondary transfer roller 21 and the tension roller 20 connected to an earth.

A sheet feed tray 41 containing a plurality of recording sheets in a stack of sheets is disposed vertically below the transfer unit 75. The sheet feed tray 41 is slidably disposed in a housing of the printer 100 and attachably detachable therefrom. The sheet feed tray 41 is so disposed as to contact a topmost sheet of the stack of the recording sheets and starts to rotate counterclockwise at a predetermined timing so that the recording sheet is sent toward a sheet conveyance path one after another.

A registration roller pair 43 including two registration rollers is disposed at an end of the sheet conveyance path. The registration roller pair 43 stops rotation of the two rollers upon the recording sheet conveyed from the sheet feed tray 41 is nipped between the rollers. Then, the registration roller pair 43 restarts rotary driving and sends the recording sheet to the secondary transfer nip, so that the nipped recording sheet is synchronized with the four-color toner image on the intermediate transfer belt 22 within the secondary transfer nip.

The four-color toner image on the intermediate transfer belt 22 contacting the recording sheet at the secondary transfer nip is transferred en bloc onto the recording sheet by the secondary transfer electric field and nip pressure, so that a full-color toner image is formed on the recording sheet with added performance from white color of the sheet. The recording sheet on which a full-color toner image is formed is separated from the secondary transfer roller 21 or the intermediate transfer belt 22 due to the curvature radius of the roller or the belt when passing through the secondary transfer nip. Via the conveyance path after the above transferring process, the recording sheet is conveyed to a fixing device 40.

Residual toner which has not been transferred to the recording sheet is adhered to the intermediate transfer belt 22 which has passed through the secondary transfer nip. The belt cleaner 21 contacts the outer surface of the intermediate transfer belt 22, and the residual toner is cleaned from the surface of the intermediate transfer belt 22 by the belt cleaner 71. The cleaner backup roller 72 is disposed on an inner loop of the intermediate transfer belt 22 and supports the cleaning process of the belt by the belt cleaner 71 from the inner side of the belt loop.

The fixing device 40 includes a fixing roller 45 including a built-in heat source 45*a* such as a halogen lamp, and a pressure roller 47 rotating while contacting the fixing roller 45 with a predetermined pressure so that a fixing nip is formed between the fixing roller 45 and the pressure roller 47. An unfixed toner image carrying surface of the recording sheet which has been sent into the fixing device 40 is closely contacted the fixing roller 45 and is sandwiched at the fixing nip. Toner in the toner image is melted due to the heat and pressure so that a full-color image is fixed onto the recording sheet.

When a single-side printing mode is set by an input via numeric keys on a control panel or by control signals from a computer, the recording sheet discharged from the fixing device 40 is discharged directly outside. The recording sheet is then stacked on a sheet stacking section on an upper surface of an upper cover 56 of the housing.

In the exemplary embodiment, four process units 26 (K, C, M, and Y) and the optical writing unit 27 construct a toner image forming unit to form a toner image.

The upper cover 56 of the housing of the printer 100 is supported about the shaft member 51 and rotatable as indicated by an arrow A of FIG. 2. When the upper cover 56 rotates counterclockwise in FIG. 2, the upper cover 56 is open with respect to the housing of the printer 100. In this state, the opening above the housing of the printer 100 is largely exposed. The optical writing unit 27 is also rotatably supported about the shaft member 51. When the optical writing unit 27 is rotated counterclockwise in FIG. 2, the upper surface of the four process units 26 (K, C, M, and Y) are exposed.

The process units 26 (K, C, M, and Y) are detached by opening the upper cover 56 and the optical writing unit 27. Specifically, when the upper cover 56 and the optical writing unit 27 are open to expose the upper surface of the process units 26 (K, C, M, and Y), and the process units 26 (K, C, M, and Y) are pulled upward, and then, the process units 26 (K, C, M, and Y) are taken from the printer body.

Because the process unit 26 can be detached after opening the upper cover 56 and the optical writing unit 27, attachment and detachment of the process unit 26 can be done without having any stress position such as bending at the waist or cowering, and by verifying an inside of the housing from above. Therefore, work burden can be reduced and any operation error can be prevented from occurring.

In the exemplary embodiment, the process unit 26 including the photoconductor unit 10 and the developer unit 23 is attachably detachable from the printer 100; however, each of the developer unit 23 and the photoconductor unit 10 may be attachably detachable from the printer 100 as an individual unit.

Figure 4:
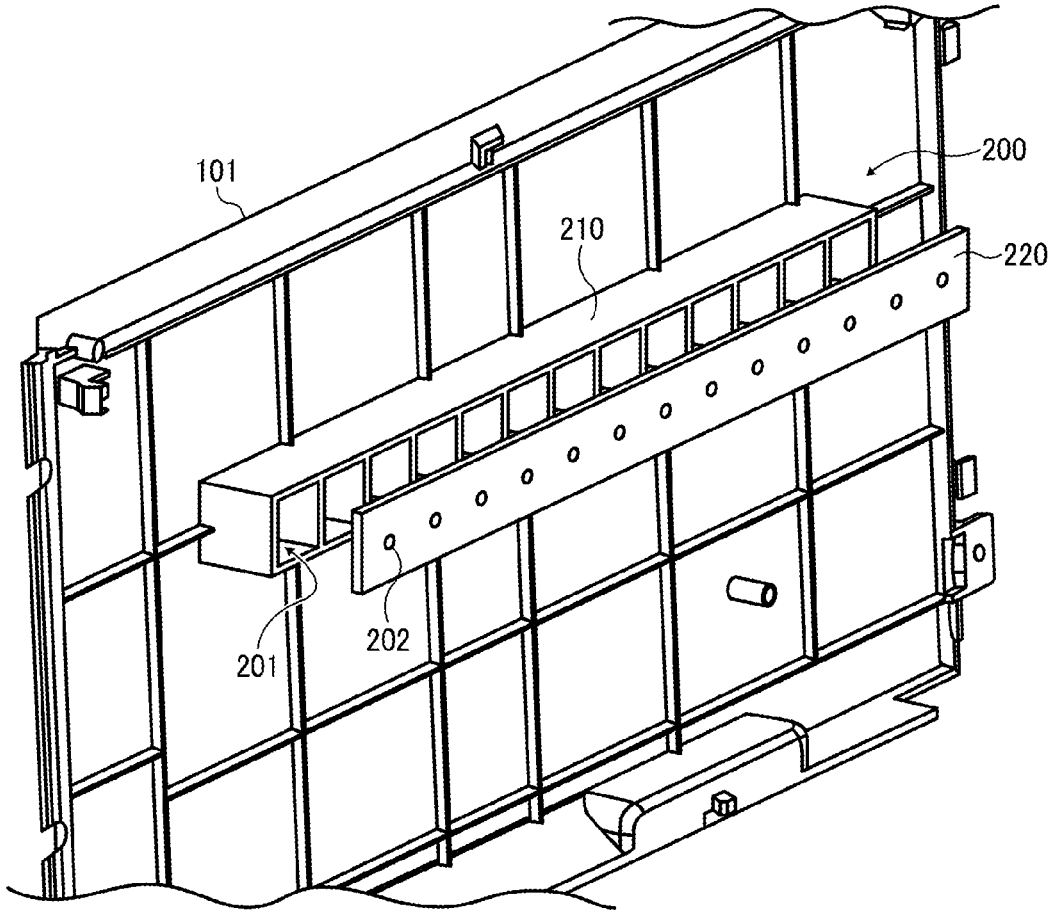
FIG. 4 illustrates an external wall of the printer seen from an interior side of an apparatus body of the printer.

FIG. 4 is a perspective view of an external wall 101 which is a left-side external wall of the printer 100, seen from an interior side of the printer.

As illustrated in FIG. 4, a cavity forming member 210 is disposed on an interior wall of the external wall 101. A port forming member 220 is secured to cover the cavity forming member 210, thereby forming an acoustic device 200 employing a Helmholtz resonator.

The external wall 101 is fixed to the housing of the printer 100 by screws and is not opened by the user even when the replacement of consumable parts is performed. In the exemplary embodiment, the external wall 101 is fixed to the housing with screws; however, any other fixing method can be employed.

The printer 100 generates various sounds such as a driving sound when transmitting a rotary drive force to the rollers from the drive motor, moving sound of each roller, and sound of rotation of the polygon mirror included in the optical writing unit 27. Such sound transmitted outside the printer 100 may be a noise that causes stress to people surrounding the printer 100. The acoustic device 200 is designed to absorb such noise.

Figure 1:
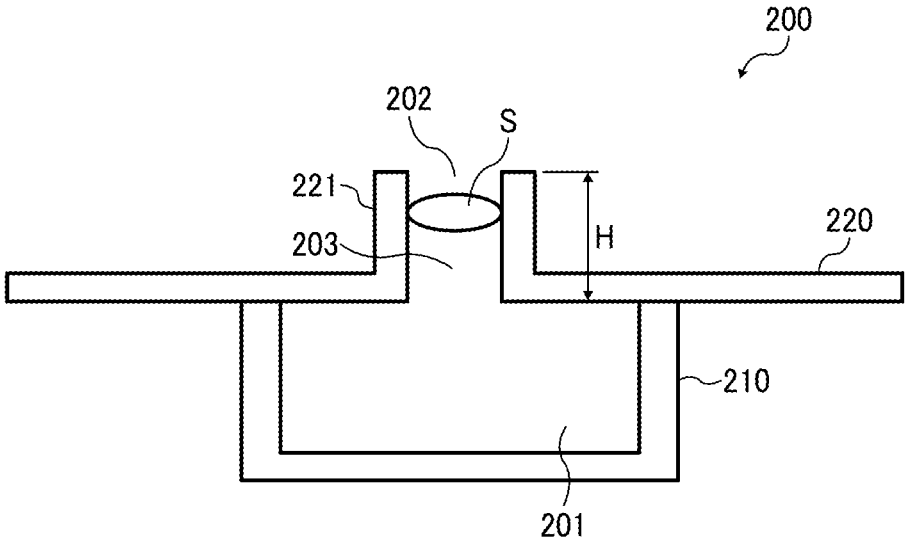
FIG. 1 schematically illustrates an acoustic device according to an embodiment of the present invention.

FIG. 1 schematically illustrates an acoustic device 200 according to an embodiment of the present invention.

The acoustic device 200 of the Helmholtz resonator includes a port forming member 220 as a first member to form a wall on which a port 203 that connects a cavity 201 and an outside. The acoustic device 200 further includes a cavity forming member 210 as a second member to form the other part of the structure of the cavity 201. In the present embodiment, the material of the cavity forming member 210 is resin, which can be manufactured easily and has a density less than that of metal, which is the material for forming the port forming member 220.

A flange 221 is formed on the port forming member 220 through burring, and the interior of the flange 221 is the port 203 having a cross-sectional area S and a length H. The port forming member 220 and the cavity forming member 210 are fastened together by screws or by insert molding. The volume of the cavity 201 formed by the cavity forming member 210 is V.

Burring is a manufacturing method used to form the flange around the opening and includes: making a base hole; inserting a punch having a greater diameter than the base hole to extend a border of the base hole; and forming a flange around the opening. The port 203 is formed by the burring, so that a material to form the port 203 is not prepared separately from the port forming member 220 that forms part of the wall to form the cavity 201, and the port 203 having an opening 202 is formed.

The acoustic device 200 as illustrated in FIG. 1 is disposed such that the opening of the port 203 faces a sound source as a sound absorption target. Thus, the sound as a sound absorption target comes in the port 203, so that an optimal sound absorption effect can be obtained.

Concerning the acoustic device 200 as illustrated in FIG. 1, if a static volume of the cavity 201 is V, a cross-sectional area of the port 203 is S, a length of the port 203 in the connection direction is H, and an acoustic velocity is c, and a resonant frequency absorbed by the acoustic device 200 is f, then the following equation stands:

$$f=c/2\pi\times\{S/(V\times H)\}^{1/2} \quad (1)$$

As represented by the formula (1), the frequency of the sound absorbed by the acoustic device 200 can be obtained by the volume V of the cavity 201, the length H of the port 203, and the cross-sectional area S of the port 203.

There are three methods, from the aforementioned formula (1), to make the frequency of the sound that the acoustic device 200 absorbs a low frequency: (i) increase the volume V of the cavity 201; (ii) lengthen the length H of the port 203; and (iii) reduce the cross-sectional area S of the port 203.

In the Helmholtz resonator, sound that enters the port 203 is absorbed, so that the cross-sectional area S of the port 203 is preferably large to improve the sound absorption effect, so it is not recommended to reduce the cross-sectional area S of the port 203 to make the frequency of the to-be-absorbed sound a lower frequency.

In addition, in a structure in which the port 203 is formed by burring, the height H of the port 203 can be determined based on the diameter of the base hole and that of the punch to extend the base hole. When the size of the base hole is the same, as the punch's diameter increases, the height H increases. However, when the punch's diameter increases, the cross-sectional area S of the port 203 also increases. If the cross-sectional area S increases, the frequency of the to-be-absorbed sound shifts to a higher frequency. Therefore, it is difficult to lower the frequency of the to-be-absorbed sound by lengthening the length H of the port 203.

Accordingly, as a method to make the frequency of the to-be-absorbed sound a lower frequency, it is preferred that the volume V of the cavity 201 be increased.

In addition, because the sound that did not enter the port 203 enters into the external wall surface around the opening of the port 203, the wall of the port 203 among the walls forming the cavity 201 is preferably formed of a metal that excels in the prevention of sound transmission.

When the sound is incident to the wall, transmission loss of the sound increases or the sound is not transmitted easily as the mass of the wall per unit area increases. When the material of the wall is uniform, the sound does not transmit through the wall as a depth of the wall is larger and a density of the material of the wall per unit area is greater. As a result, among the walls to form the cavity 201, the wall on which the port 203 is disposed is formed of sheet metal with a density higher than that of the resin used to form the cavity forming member 210, so that the transmission of the sound can be restricted. Further, if the wall of the port 203 is formed of sheet metal, because the sound on a side opposite the sound source is not transmitted abut is to a large extent reflected, the sound directed to the port 203 of the Helmholtz resonator after being reflected increases relatively, so that the sound absorption effect can be improved.

The acoustic device 200 according to the exemplary embodiment includes the cavity 201 formed inside the cavity forming member 210 made of resins, and the port 203 formed of the port forming member 220 made of sheet metal serving as a cover of the port 203. Because the cavity 201 is formed by the cavity forming member 210, the volume of the cavity 201 can be increased, so that the frequency of the to-be-absorbed sound can be set to a low frequency.

As the metal for the port forming member 220, an iron plate such as a galvanized steel plate may be used. Alternatively, aluminum plate or other metals may be used. Examples of resin materials for the cavity forming member 210 include polycarbonate or ABS resins, but not limited thereto.

If the frequency of the sound absorbed by the acoustic device 200 is the same, the cross-sectional area S of the port 203 is set to be relatively large by increasing the volume of the cavity 201, which makes the sound incoming to the port 203 easier and improves the sound absorption effect.

The port 203 is formed employing the plate member with burring method, so that the length H of the port 203 can be longer than a structure in which a hole is simply bored through the plate member and the length H of the port 203 corresponds to a thickness of the plate member. As a result, if the frequency of the sound absorbed by the acoustic device 200 is the same, the cross-sectional area S of the port 203 is set to be relatively large, thereby improving the sound absorption effect.

The image forming apparatus disclosed in JP-3816678-B includes the acoustic device employing a Helmholtz resonator, in which the cavity is formed by overlapping two pieces of sheet metal. When forming a cavity by processing sheet metal, the sheets are bent, squeezed, and joined to each other. However, because sheet metal is difficult to process, it is difficult to form the cavity including a large volume with high precision while maintaining a good seal. Accordingly, the structure to form a cavity with sheet metal alone as disclosed in JP-3816678-B requires that the cross-sectional area S of the port is reduced to absorb the sound with a low frequency. However, as noted above, an acoustic device employing a Helmholtz resonator absorbs the sound incoming through an opening of the port into the cavity. Reducing the cross-sectional area S of the part is not preferable because the sound absorption effect is lowered.

By contrast, the acoustic device 200 according to the present exemplary embodiment includes the cavity 201 formed of the cavity forming member 210 employing resins. Part formed of resins can be molded into a desired shape with precision by casting the resinous material in a metal mold. Thus, the acoustic device 200 of the present embodiment can provide the cavity 201 including a large volume with high precision while maintaining a good seal.

When the port forming member 220 and the cavity forming member 210 are closely attached by insert molding, the metal-made port forming member 220 is secured to the metal mold to form the cavity forming member 210 as an insert part. Then, the metal mold is filled with the resinous material for the cavity forming member 210. When the resins are cured, the cavity forming member 210 is closely secured to the port forming member 220. Use of the insert molding enables the number of steps to produce the acoustic device 200 to be reduced compared to a method to join the port forming member 220 and the cavity forming member 210 that are individually formed and to reduce the production cost. Further, compared to the structure to join the parts, the sealing property at a boundary of the port forming member 220 and the cavity forming member 210 can be improved and the sound absorption effect can be improved.

The printer 100 includes an external cover formed of resinous material and disposed to cover the sound sources, such as the polygon mirror and the drive motor, which emit sound when operating. As illustrated in FIG. 4, the external wall 101 as a part of the external cover formed of resinous material serves as the cavity forming member 210 that forms a wall other than the wall on which the port 203 of the cavity 201 is disposed. Because the cavity forming member 210 is added to the external wall 101 which functions as an external cover, the cavity forming member 210 to construct the acoustic device 200 needs not provided separately. With this structure, the printer 100 can be manufactured with a reduced number of parts, thereby reducing the weight and the size of the printer 100 and a manufacturing cost thereof.

Figure 5:
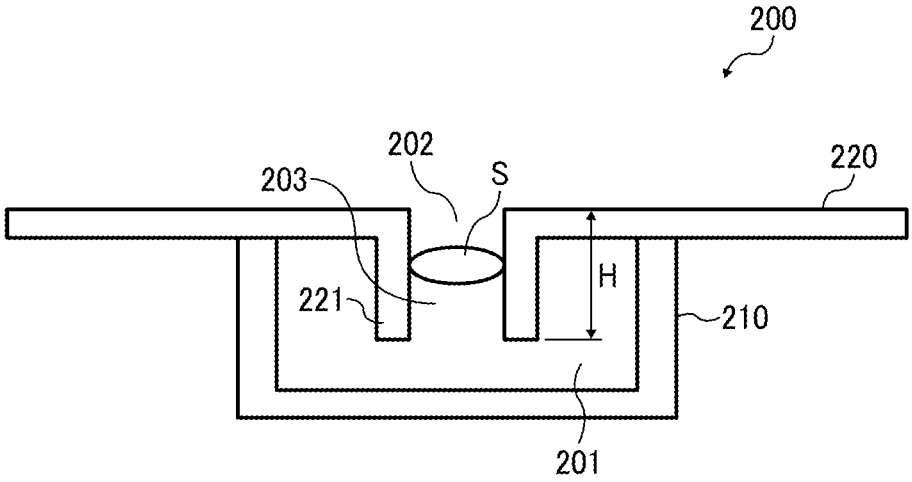
FIG. 5 schematically illustrates an acoustic device including a port, a port forming member, a cavity, and a cavity forming member, in which the port is disposed farther inside the cavity than the port forming member.

FIG. 5 illustrates the acoustic device 200 including the port 203 disposed farther inside the cavity 201 than the port forming member 220.

Edges of the opening 202 of the port 203 formed by burring may include burrs, and the burrs are not desired for a user or a service person to come in touch with the printer 100 in maintenance, for example. In the structure as illustrated in FIG. 5, because the flange 221 extends into an interior of the cavity 201, the edge portion of the opening 202 of the port 203 positions inside the cavity 201, and therefore, the burrs, if any, cannot be touched from outside. With this structure, the acoustic device 200 can be disposed at a position which the user or service personnel may come in touch with.

Figure 6:
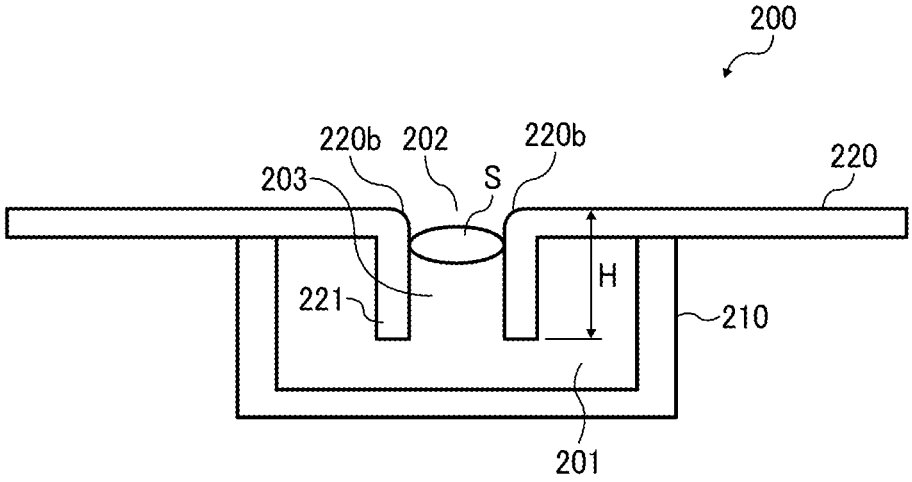
FIG. 6 schematically illustrates the acoustic device of FIG. 5 including an opening with a round corner portion.

FIG. 6 illustrates an acoustic device of FIG. 5 including the opening 202 with round corner portions 220*b*. Because the opening 202 includes the round corner portions 220*b*, the sound easily enters the port 203, and an optimal sound absorption effect can be obtained.

Figure 7:
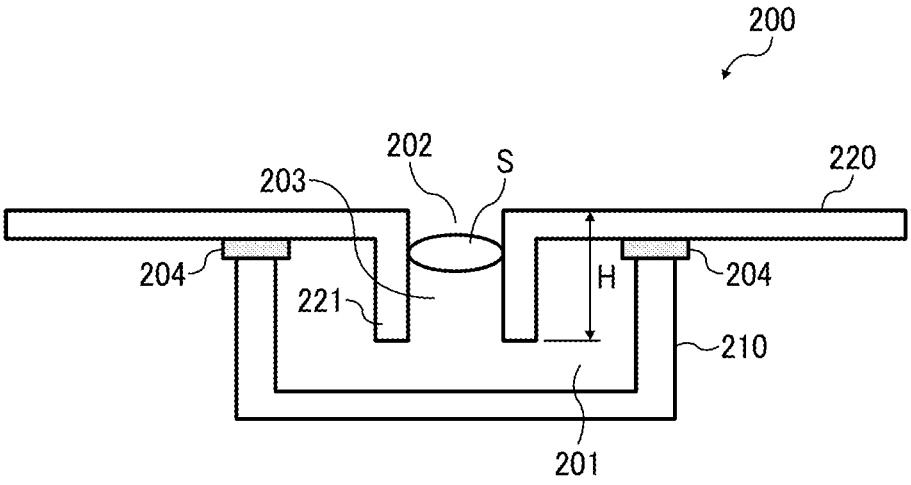
FIG. 7 schematically illustrates an acoustic device including a sealing member disposed at each joint portion between the port forming member and the cavity forming member.

FIG. 7 illustrates the acoustic device 200 including a sealing member 204 disposed at each joint portion between the port forming member 220 and the cavity forming member 210. The sealing member 204 positions between the port forming member 220 and the cavity forming member 210 and deforms, by being pressed, along each surface of the port forming member 220 and the cavity forming member 210. Further, compared to the structure to join the parts, the seal at a boundary of the port forming member 220 and the cavity forming member 210 can be improved and the sound absorption effect can be improved.

The sealing member 204 may be an elastic member formed of rubber. However, the sealing member 204 is not limited to an elastic member that returns to an original state when released from the pressure after deformation, but may be a member such as clay that remains deformed even when released from the pressure as far as the joint portion between the port forming member 220 and the cavity forming member 210 is closely sealed.

Figure 8:
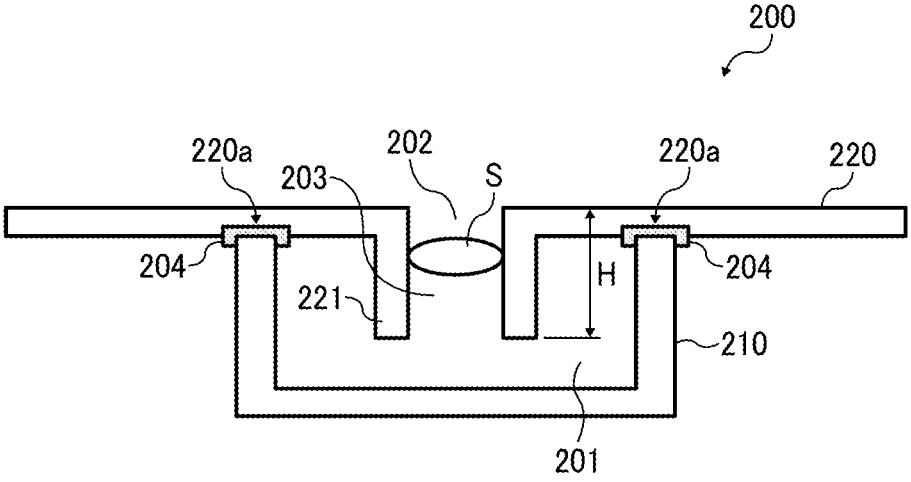
FIG. 8 schematically illustrates an acoustic device including a groove portion disposed at each joint portion between the port forming member and the cavity forming member, and the sealing member is disposed in the groove portion.

FIG. 8 illustrates a structure in which a groove portion 220*a* is created on the port forming member 220 at the joint portion between the port forming member 220 and the cavity forming member 210, and each sealing member 204 is disposed in each groove portion 220*a*. The groove portion 220*a* is disposed and the sealing member 204 is disposed in the groove portion 220*a*, so that the seal is further improved and the sound absorption effect is enhanced. In FIG. 8, the groove portion is disposed on the port forming member 220; however, the same may be disposed on the cavity forming member 210.

Instead of the sealing member 204 as illustrated in FIGS. 7 and 8, grease may be coated on the joint portion, which may improve lubrication of the driving part such as gears. The grease has high viscosity and does not flow easily, so that the grease can be retained at the joint portion. When the grease coated on the joint portion is sandwiched between the port forming member 220 and the cavity forming member 210 and is pressed thereby, the grease moves along the surface of the port forming member 220 and the cavity forming member 210, thereby securing the sealing property of the joint portion. In the structure to coat the grease, because the number of parts can be reduced compared to the structure to provide the sealing member 204, assembling property is improved, low cost manufacturing is achieved, and services of repair and maintenance can be improved.

It is noted that leakage of the grease can be reliably prevented by providing the groove portion at each joint portion as illustrated in FIG. 8.

<Modified Example>

Figure 9:
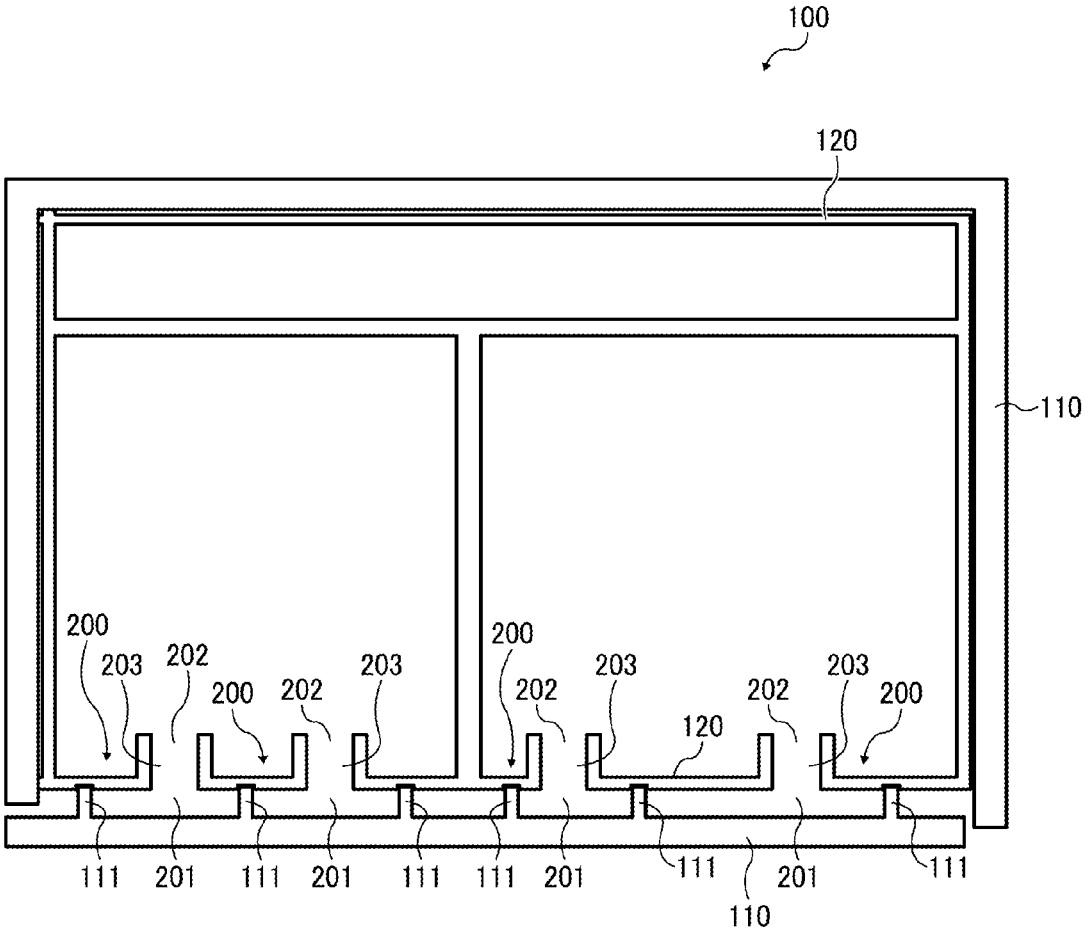
FIG. 9 illustrates a housing of the printer and an external cover according to a modified embodiment of the present invention.

FIG. 9 schematically illustrates a housing 120 of the printer 100 and an external cover 110 according to a modified embodiment of the present invention.

In the present modified example, the structure of the printer 100 and its operation to form an image is similar to the exemplary embodiment described heretofore.

The printer 100 includes the housing 120 formed of metal and various parts and components are secured to the housing 120. The resin-made external cover 110 covers the housing 120. The plurality of ports 203 of the Helmholtz resonator is formed on the thus-formed housing 120 of the printer 100. A plurality of cylindrical ribs 111 is so formed as to surround each portion opposite the port 203. As illustrated in FIG. 9, a tip end of the rib 111 joins the surface of the housing 120, thereby forming a cavity 201 of the Helmholtz resonator between the external cover 110 and the housing 120.

In the modified printer 100, the housing 120 serves as the port forming member 220 as a first member and the external cover 110 serves as the cavity forming member 210 as a second member.

In the modified example, because the acoustic device 200 employing the Helmholtz resonator is formed by adjusting shapes of joining parts with the housing 120 and the external cover 110, the number of parts employed in the printer 100 can be reduced, thereby achieving weight reduction of the printer and production thereof at a lower cost.

The modified example may further include a cavity forming member 210 other than the external cover 110.

When the cavity forming member 210 and the port forming member 220 are newly added to form the acoustic device 200 employing the Helmholtz resonator, which may result in increase in production cost and weight, and therefore, is not preferable. By contrast, when part of the housing 120 is used to form the port forming member 220, the port forming member 220 need not be provided in addition to the housing 120. As a result, space reduction, weight reduction, reduction of the number of parts, and a low manufacturing cost may be achieved.

Further, the housing 120 of the printer 100 has bored holes for weight reduction. Such holes may be used as the ports 203 for the Helmholtz resonator, thereby making a process to bore the hole for the port 203 unnecessary and enabling to reduce the manufacturing cost.

In the exemplary embodiments of the present invention, a case in which an electronic device employing the acoustic device is an image forming apparatus; however, the present invention may be applied to any other electronic device other than the image forming apparatus as far as the electronic device includes a sound source to emit sound during operation and an acoustic device to absorb the sound emitted from the sound source.

The aforementioned embodiments are examples and specific effects can be obtained for each of the following aspects of (A) to (M):

<Aspect A>

An acoustic device 200 employing Helmholtz resonator, including: a first member such as a port forming member 220 forming a wall on which ports such as a plurality of ports 203 that communicates to an outside, among walls forming a cavity such as a cavity 201 of the Helmholtz resonator; and a second member such as a cavity forming member 210 to form the other wall of the cavity. The second member formed of a resin that can be manufactured easily with a density lower than that of the first member such as a metal.

With such a structure, as described in the above embodiments, because the first member is formed of a material with a density higher than that of the second member, the transmitted sound can be restricted more than the structure formed of the material used solely for the second member. In addition, because the second member is formed of a material easily manufactured than the material for the first member, the sealing property is improved and the volume of the cavity can be secured with high precision than the structure formed of solely the first member. By securing the volume in the cavity, sound with a low frequency can be absorbed. By forming the cavity with high precision, the sound absorption effect can be improved while maintaining a good seal.

The present invention provides an optimal acoustic device according to the aspect A, capable of reducing the transmitted sound and increasing the sound absorbing effect with respect to the low-frequency sound.

<Aspect B>

In the aspect A, materials for the first member such as the port forming member 220 include metals, and materials for the second member such as the cavity forming member 210 include resins.

With such a structure, as described in the above embodiments, because the first member is formed of a material with a density higher than that of the second member, the transmitted sound can be restricted more effectively. In addition, because the second member is formed of the resins easily manufactured than the metals, the cavity can be formed with higher precision while maintaining a good seal. As a result, the acoustic device according to the aspect B improves the sound absorption effect with respect to the low-frequency sound while restricting the transmitted sound.

<Aspect C>

In either of the aspect A or B, a through-hole such as the port 203 of the port forming member 220 as the first member is formed by burring to a plate member.

With this, as described in the present embodiments, without separately providing a member to form the port to the first member forming part of the wall of the cavity 201, a port with an opening such as the opening 202 can be created. Thus, the acoustic device can be manufactured at a low cost.

<Aspect D>

In either aspect A to C, an opening such as the opening 202 of the port 203 includes round corner portions 220*b*.

As a result, the sound easily comes inside the port 203, and an optimal sound absorption effect can be obtained.

<Aspect E>

In either aspect A to D, the port 203 is disposed inside the cavity 201.

With this structure, the acoustic device 200 can be disposed at a position which the user or the service person may come in touch with.

<Aspect F>

In either aspect A to E, one of the port forming member 220 as the first member and the cavity forming member 210 as the second member is made an insert part and the other is formed by insert molding.

With this aspect, manufacturing costs can be reduced by a reduction of the number of assembly processes, the sealing property at a boundary of the port forming member 220 and the cavity forming member 210 can be improved, and the sound absorption effect can be improved.

<Aspect G>

In either aspect A to E, a deformable member such as a sealing member 204 is disposed, which is sandwiched by the first member such as the port forming member 220 and the second member such as the cavity forming member 210 and deforms, by being pressed, along each surface of the first and second members.

With this aspect, a gap is prevented from being generated at the connection portion, the sealing property of the cavity 201 can be improved, and the sound absorption effect can be improved.

<Aspect H>

In either aspect A to E, a grease is coated on a joint portion between the first member such as the port forming member 220 and the second member such as the cavity forming member 210.

With this aspect, a gap is prevented from being generated at the joint portion with a structure that can be provided at a low cost, a sealing property of the cavity 201 is improved, and the sound absorption effect can be obtained.

<Aspect I>

In either aspect G or H, a groove portion 220*a* is disposed at a joint portion between the first member such as the port forming member 220 and the second member such as the cavity forming member 210.

With this structure, a further sealing property can be obtained by the structure to provide the deformable member or the grease to the joint portion.

<Aspect J>

An electronic device such as a printer 100 including an acoustic device to absorb sound during printing, includes an acoustic device 200 as a sound absorption means according to one of the aspects A to I.

With this structure, while restricting transmitted sound during the operation of the electronic device, the sound absorption effect relative to the sound with a low frequency can be improved.

<Aspect K>

In the aspect J, a structure member such as the housing 120 that supports a sound source such as a polygon mirror that emits sound during operation is disposed. At least a part of the structure member serves as a wall on which the port 203 is disposed, that is, as the first member such as the port forming member 220, among the walls forming the cavity 201.

With this structure, the printer 100 can be manufactured with a reduced number of parts, thereby reducing the weight and the size of the printer 100 and a manufacturing cost thereof.

<Aspect L>

In any one of the aspect J or K, a resinous member such as an external cover 110 is disposed to cover sound sources such as a polygon mirror and a driving motor that emit sound during operation, and a part (the external cover 110) of the resinous member serves as the second member such as the cavity forming member 210 and forms a wall other than the wall on which the port 203 of the cavity 201 is disposed.

With this structure, the printer 100 can be manufactured with a reduced number of parts, thereby reducing the weight and the size of the printer 100 and a manufacturing cost thereof.

<Aspect M>

An electrophotographic image forming apparatus such as a printer 100 including an electronic device according to any one of the aspects J to L.

With this structure, while restricting transmitted sound during the operation of the image forming apparatus, the sound absorption effect relative to the sound with a low frequency can be improved.

Additional modifications and variations of the present invention are possible in light of the above teachings. It is therefore to be understood that, within the scope of the appended claims, the invention may be practiced other than as specifically described herein.

What is claimed is:

1. An electronic device comprising:
an external wall; and
an acoustic device including,
a first member having an opening therein formed by a protrusion, and
a second member joined to the first member, thereby forming a cavity therebetween, the second member being a part of the external wall, wherein
the external wall and the second member include a resin material.

2. The electronic device of claim 1, wherein the first member and the protruding portion include a same material.

3. The electronic device of claim 1, wherein
the first member includes a first material and the second member includes a second material, and
the second material has a lower density than the first material.

4. The electronic device of claim 1, wherein
the first member is plate-shaped and includes a metal material, and
the first member has a burr thereon that forms the protruding portion.

5. The image forming apparatus of claim 1, wherein the external wall includes an external cover configured to cover internal components of the electronic device therein, and the second member includes a plurality of ribs on the external cover, and the image forming apparatus further comprises:
a housing configured to have one or more of the internal components attached thereto, the first member including a portion of the housing such that a side of the housing corresponding to the external cover has the protrusion thereon.

6. The image forming apparatus of claim 5, wherein the first member and the protruding portion include a same material.

7. The image forming apparatus of claim 5, wherein
the first member includes a first material and the second member includes a second material, and
the second material has a lower density than the first material.

8. The image forming apparatus of claim 5, wherein
the first member is plate-shaped and includes a metal material, and
the first member has a burr thereon that forms the protruding portion.

9. The electronic device of claim 1, wherein
the first member includes a first material and the second member includes a second material, the second material having a lower density than the first material, and
the external wall and the second member include a resin material.

10. An electronic device comprising:
an external wall; and
an acoustic device including,
a first member having an opening therein formed by a protrusion, and
a second member joined to the first member, thereby forming a cavity therebetween, the second member being a part of the external wall, wherein
the first member and the protruding portion include a same material.

11. The electronic device of claim 10, wherein
the first member is plate-shaped and includes a metal material,
the first member has a burr thereon that forms the protruding portion, and
the first member and the protruding portion include a same material.

12. An electronic device, comprising:
an external wall including an external cover configured to cover internal components of the electronic device therein, the external cover having a plurality of ribs on an inside surface thereof;
an acoustic device including,
a first member having an opening therein formed by a protrusion, and
a second member joined to the first member, thereby forming a cavity therebetween, the second member being a part of the external wall, the second member including the inside surface of the external cover such that the plurality of ribs define sides of the cavity when the second member joins the first member; and
a housing configured to have one or more of the internal components attached thereto, the first member including a portion of the housing such that a side of the housing corresponding to the external cover has the protrusion thereon.

* * * * *